US006922861B1

(12) United States Patent
Mathis

(10) Patent No.: US 6,922,861 B1
(45) Date of Patent: Aug. 2, 2005

(54) CHILD LOUNGE

(76) Inventor: Michelle L. Mathis, 3115 W. Salter Dr., Phoenix, AZ (US) 85027

( * ) Notice: Subject to any disclaimer, the term of this patent is extended or adjusted under 35 U.S.C. 154(b) by 0 days.

(21) Appl. No.: 10/667,687

(22) Filed: Sep. 22, 2003

(51) Int. Cl.[7] ..... A47D 13/08
(52) U.S. Cl. ..... 5/655; 5/425; 5/915
(58) Field of Search ..... 5/655, 632, 630, 5/424, 425, 427, 915; 128/845, 875, 846

(56) References Cited

U.S. PATENT DOCUMENTS

| | | | | | |
|---|---|---|---|---|---|
| 3,284,817 | A | * | 11/1966 | Landwirth | 5/647 |
| 4,383,713 | A | | 5/1983 | Roston | 297/228.12 |
| 4,471,767 | A | * | 9/1984 | Guimond | 601/5 |
| 4,566,449 | A | | 1/1986 | Smith | 5/603 |
| 4,802,244 | A | * | 2/1989 | McGrath-Saleh | 2/69 |
| 4,825,487 | A | | 5/1989 | Eberl | 5/655 |
| 4,862,535 | A | | 9/1989 | Roberts | 5/655 |
| 5,046,487 | A | * | 9/1991 | Scott | 601/27 |
| 5,208,925 | A | * | 5/1993 | Edlund | 5/424 |
| 5,331,699 | A | * | 7/1994 | Patton et al. | 5/655 |
| 5,357,642 | A | | 10/1994 | Clute | 5/655 |
| 5,411,457 | A | | 5/1995 | Hartdegen, III et al. | 482/96 |
| 5,439,008 | A | | 8/1995 | Bowman | 128/875 |
| 5,450,640 | A | * | 9/1995 | Patton et al. | 5/655 |
| 5,675,853 | A | | 10/1997 | Linge | 5/655 |
| 5,697,113 | A | | 12/1997 | Shatz et al. | 5/655 |
| 5,700,059 | A | | 12/1997 | Moscot | 297/452.17 |
| 5,800,368 | A | | 9/1998 | Klingemann et al. | 602/1 |
| 6,023,802 | A | | 2/2000 | King | 5/655 |
| 6,097,294 | A | * | 8/2000 | Hilton | 340/573.1 |
| 6,175,981 | B1 | | 1/2001 | Lizama et al. | 5/655 |
| 6,292,964 | B1 | | 9/2001 | Rose et al. | 5/655 |
| 6,564,408 | B2 | * | 5/2003 | Van Vuuren | 5/655 |
| 2002/0023301 | A1 | | 2/2002 | Vuuren | 5/655 |
| 2002/0042954 | A1 | | 4/2002 | Straub | 5/655 |

* cited by examiner

*Primary Examiner*—Robert G. Santos
(74) *Attorney, Agent, or Firm*—Parsons & Goltry; Michael W. Goltry; Robert A. Parsons

(57) ABSTRACT

Disclosed is a device for holding and supporting an infant, which consists of a base including a proximal extremity, an opposing distal extremity, and an edge therebetween. The base has an inclined surface extends from the proximal extremity to the edge, and a generally horizontal surface extends from the edge to the distal extremity. A body-supporting harness assembly, located atop the inclined surface, is attached to the base and is movable between a first body supporting position away from the general horizontal surface and a second position toward the generally horizontal surface.

18 Claims, 4 Drawing Sheets

CHILD LOUNGE

FIELD OF THE INVENTION

This invention relates to support structures and sleeping devices for infants.

BACKGROUND OF THE INVENTION

Of all the challenges that face new parents, providing a newborn baby with a comfortable and safe place to sleep is among the most important to meet. Given this long-standing need, skilled artisans have devoted considerable effort toward sleeping structures and support devices that are adapted and arranged specifically for infants. Although the field of infant supports and sleeping devices has enjoyed a considerable amount of attention by those skilled in the art, existing infant supports and sleeping devices are cumbersome, difficult to construct, expensive, and incorporate structural features that still fail to provide infants with a safe and comfortable place to rest and play in both prone and supine positions. Given these and other deficiencies in the art, the need for certain new and useful improvements is evident.

Accordingly, what is need is a child lounge that is inexpensive, easy to construct, that incorporates structure for safely and comfortably supporting a child in a prone position and in a supine position, that provides improvements for promoting relaxation and sleep, and that provides improvements for promoting strengthening of the neck and back of an infant held and supported by the child lounge in a supine position.

SUMMARY OF THE INVENTION

The above problems and others are at least partially solved and the above purposes and others realized in new and improved apparatus for holding and supporting an infant, which consists of a base including a proximal extremity, an opposing distal extremity, and edge therebetween. The base has an inclined surface that extends from the proximal extremity to the edge, and a generally horizontal surface that extends from the edge to distal extremity. A body-supporting harness assembly is attached to the base and located atop the inclined surface, and is movable between a first body supporting position away from the general horizontal surface and a second position toward the generally horizontal surface. The base has opposing sides. Further to the immediate embodiment are opposing, elongate lateral guards. One of the lateral guards is attached to the inclined surface adjacent one of opposing sides of the base, and extends from proximate the proximal extremity to proximate the edge. The other of the lateral guards is attached to the inclined surface adjacent the other of the opposing sides of the base, and extends from proximate the proximal extremity to proximate the edge. The opposing lateral guards cooperate to inhibit lateral movement of an infant positioned therebetween on the inclined surface. Preferably, the lateral guards each taper upwardly from the proximal extremity of the base to the edge. Still further to this embodiment, is an elongate transverse body-supporting element, which is attached to the inclined surface adjacent the proximal extremity. A vibrator attached to the base, and is operable for vibrating the base. In a preferred embodiment, a pocket extends into the base underneath the generally horizontal surface, and the vibrator is disposed in the pocket.

Another apparatus embodiment for holding and supporting an infant consists of a base that includes a proximal extremity, an opposing distal extremity, and an edge therebetween. The base also includes an inclined surface that extends from the proximal extremity to the edge, and a generally horizontal surface that extends from the edge to distal extremity. In this preferred embodiment, a pocket extends into the base underneath the generally horizontal surface, which is adapted to receive therein a vibrator operable for vibrating the base. A body-supporting harness assembly is attached to the base, which is movable between a first body supporting position away from the general horizontal surface and a second position toward the generally horizontal surface. In a particular embodiment, a vibrator disposed in the pocket. The base has opposing sides. Further to the immediate embodiment are opposing, elongate lateral guards. One of the lateral guards is attached to the inclined surface adjacent one of opposing sides of the base, and extends from proximate the proximal extremity to proximate the edge. The other of the lateral guards is attached to the inclined surface adjacent the other of the opposing sides of the base, and extends from proximate the proximal extremity to proximate the edge. The opposing lateral guards cooperate to inhibit lateral movement of an infant positioned therebetween on the inclined surface. Preferably, the lateral guards each taper upwardly from the proximal extremity of the base to the edge. Still further to this embodiment, is an elongate transverse body-supporting element, which is attached to the inclined surface adjacent the proximal extremity.

Yet another apparatus for holding and supporting an infant consists of a base including opposing sides, opposing proximal and distal extremities, and a transverse edge, between the proximal extremity and the distal extremity, that extends from one of the sides of the base to the other of the sides of the base. The base has an inclined surface that extends from the proximal extremity to the edge, and a generally horizontal surface that extends from the edge to distal extremity. A body-supporting harness assembly, disposed atop the inclined surface, is attached to the base and is movable between a first body supporting position away from the general horizontal surface and a second position toward the generally horizontal surface. An elongate lateral guard attached to the inclined surface adjacent one of opposing sides of the base and extends from proximate the proximal extremity to proximate the edge, and an opposing elongate lateral guard is attached to the inclined surface adjacent the other of the opposing sides of the base and extends from proximate the proximal extremity to proximate the edge. The lateral guards cooperate to inhibit lateral movement of an infant positioned therebetween on the inclined surface. Preferably, the lateral guards each taper upwardly from the proximal extremity of the base to the edge. Further to this embodiment is an elongate transverse body-supporting element, which is attached to the inclined surface adjacent the proximal extremity and to the first and second lateral supports. A vibrator is attached to the base and is operable for vibrating the base. In a particular embodiment, a pocket extends into the base underneath the generally horizontal surface, and the vibrator is disposed in the pocket.

Consistent with the foregoing summary of preferred embodiments and the ensuing specification, which are intended to be taken together, the invention also contemplates further apparatus and method embodiments.

BRIEF DESCRIPTION OF THE DRAWINGS

Referring to the drawings.

DETAILED DESCRIPTION OF PREFERRED EMBODIMENTS

Figure 1:
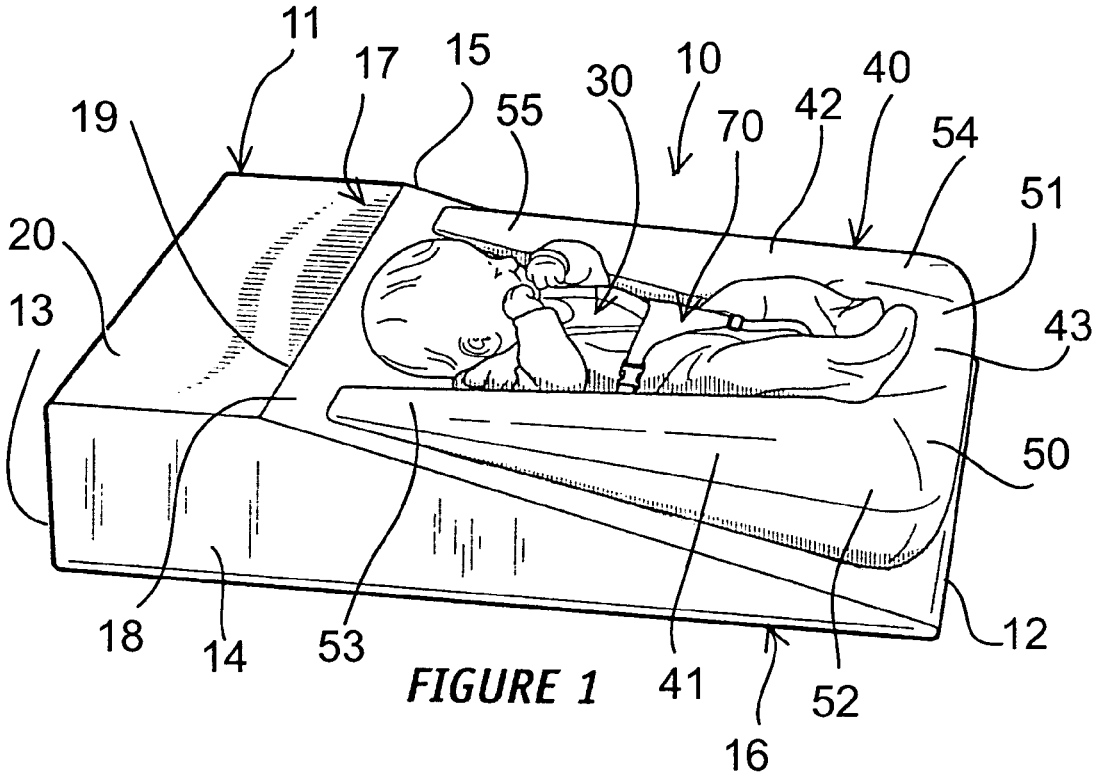
FIG. 1 is an isometric view of a child lounge shown as it would appear in use holding and supporting a child in a supine position.
Figure 2:
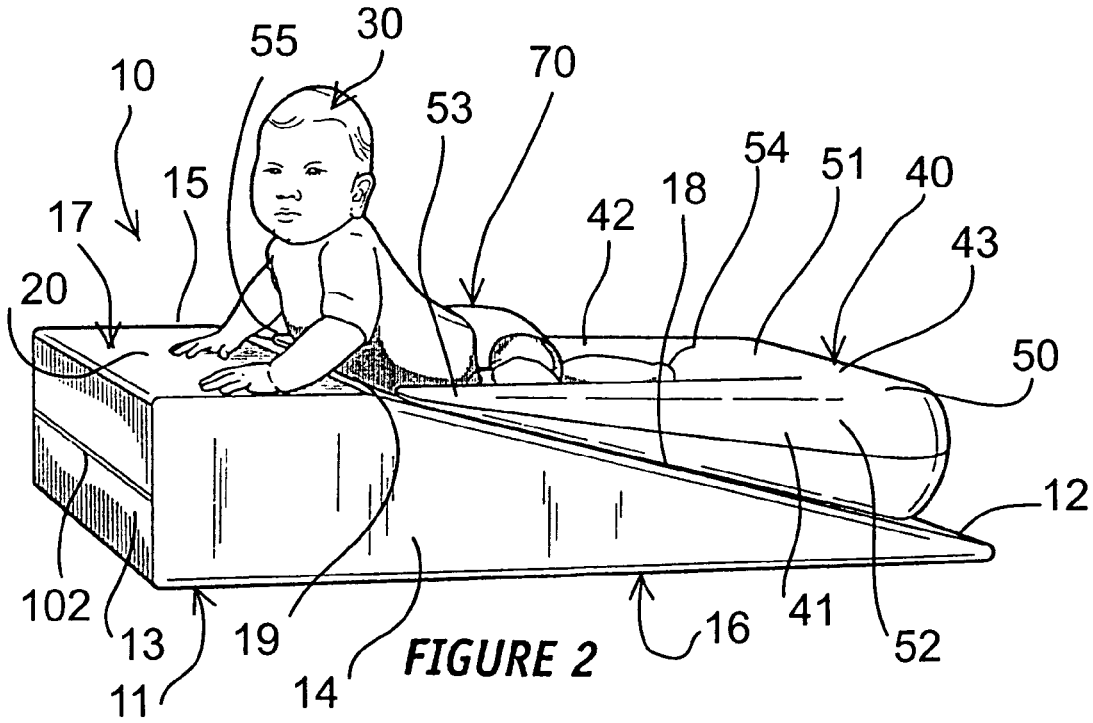
FIG. 2 is an isometric view of the child lounge of FIG. 1 shown as it would appear in use holding and supporting a child in a prone position.
Figure 7:
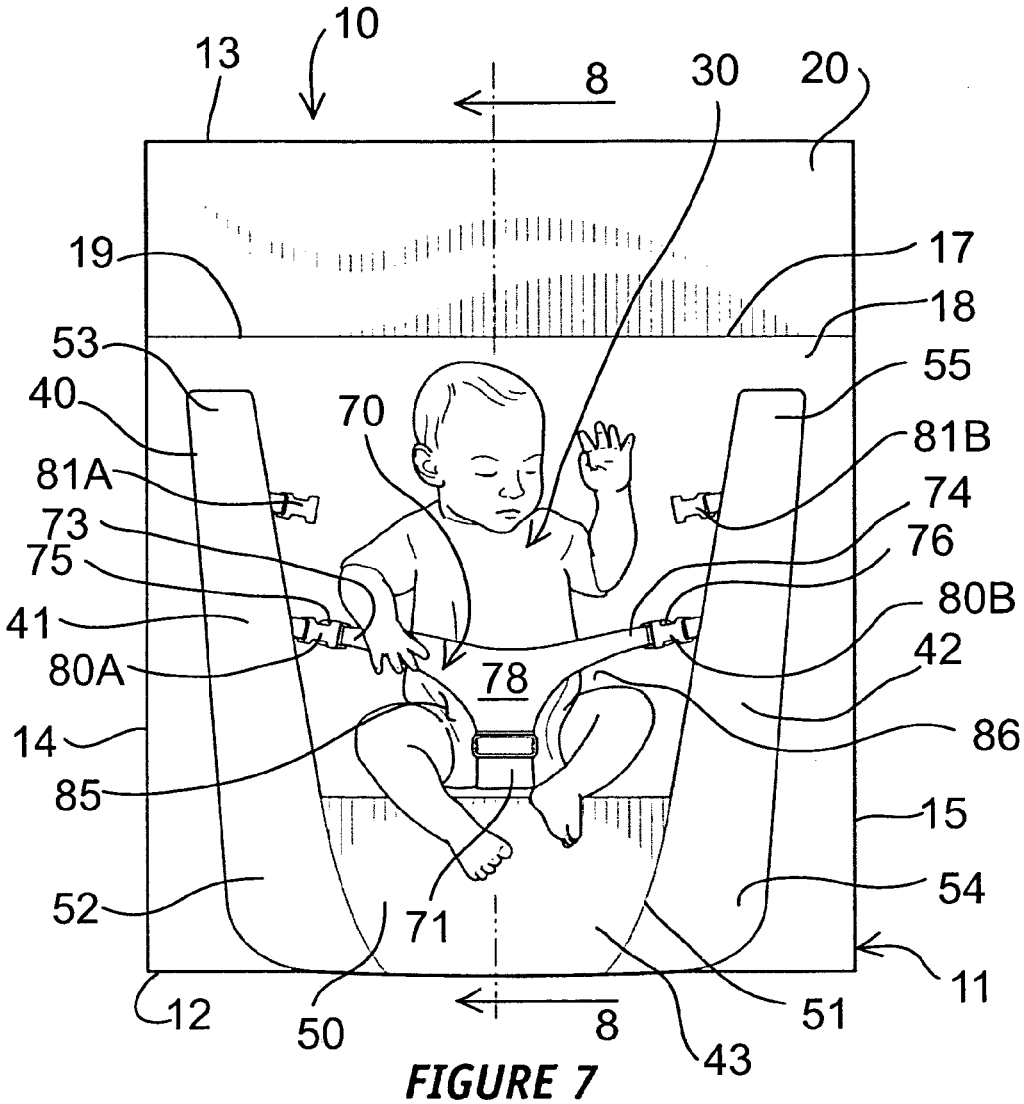
FIG. 7 is a top plan view of the child lounge of FIG. 1 shown as it would appear in use holding and supporting a child in a supine position.

Turning now to the drawings, in which like reference characters indicate corresponding elements throughout the several views, attention is first directed to FIGS. 1 and 2, in which there is seen a child lounge, embodying the principle of the instant invention, generally indicated by the reference character 10. Lounge 10 is fashioned of a soft resilient foam material or other similar material or combination of materials so as to be comfortable for a child, and is adapted and arranged to hold and support an infant or small child in a supine position and in a prone position. FIGS. 1 and 7 illustrate lounge 10 as it would appear in use holding and supporting a child 30 in a supine position. FIG. 2 illustrates lounge 10 as it would appear in use holding child 30 in a prone position. Lounge 10 can be integrally formed, or fashioned as an assembly of two or more attached parts. Preferably, lounge 10 is upholstered in a conventional manner with a selected fabric.

Figure 3:
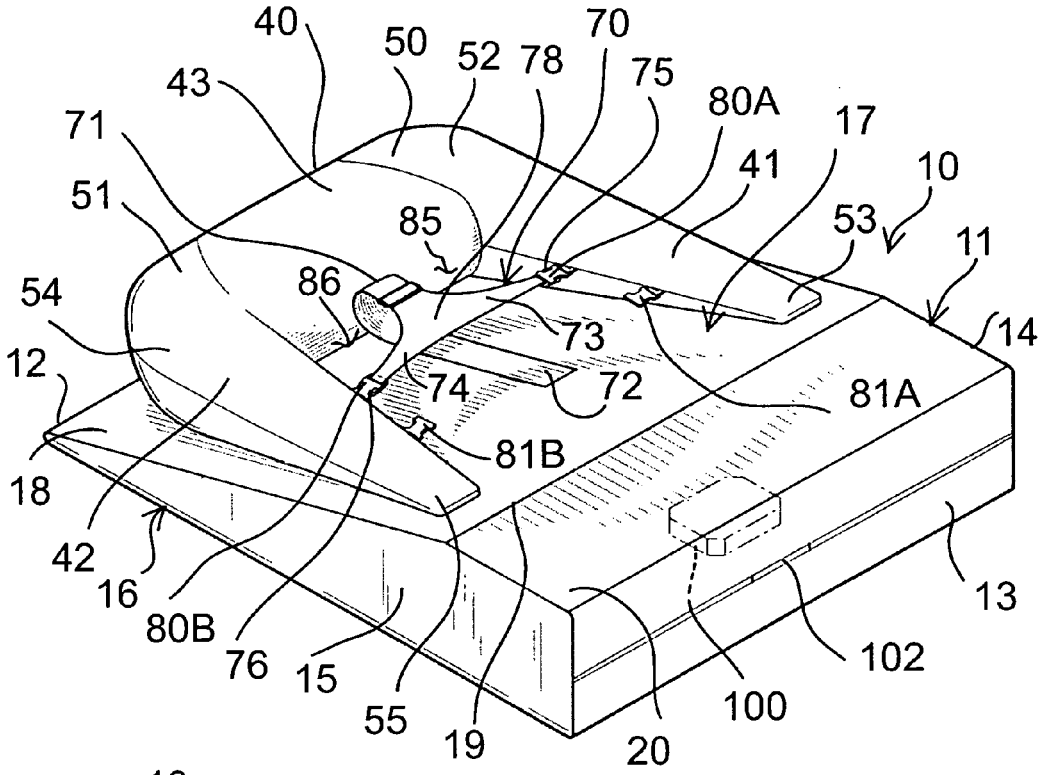
FIG. 3 is a top isometric view of the child lounge of FIG. 1 with a vibrator, shown in phantom outline, held therein.

Further to FIGS. 1 and 2 and also referring to FIG. 3, lounge 10 consists of a base 11 having a proximal extremity 12, an opposing distal extremity 13, opposing lateral extremities or sides 14 and 15, a lower face 16, and an upper face 17. Upper face 17 is characterized by an inclined surface 18 that extends from proximal extremity 12 to an edge 19 of base 11, and a generally horizontal surface 20 that extends from edge 19 to distal extremity 13. Edge 19 is transverse relative to base 11, in that it extends from side 14 to side 15. Inclined surface 18 is the main support surface for a child, and is considerably larger than horizontal surfaced 20 as generally illustrated. Inclined surface 18 is disposed at a given angle, that is preferably approximately 10–20 degrees relative to the horizontal and, moreover, relative to generally horizontal surface 20. Inclined surface 18 can be disposed at any desired and appropriate inclined angle relative to generally horizontal surface 20, such as less than 10 degrees or greater than 20 degrees.

Figure 4:
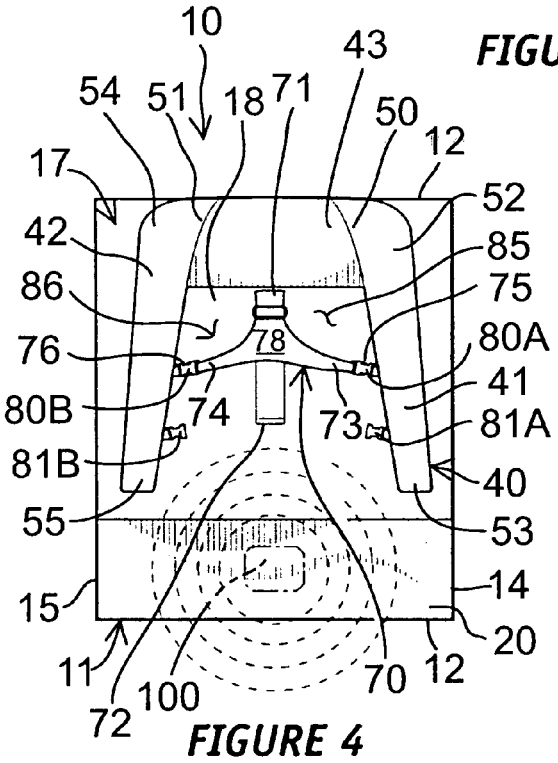
FIG. 4 is a top plan view of the child lounge of FIG. 1.
Figure 5:
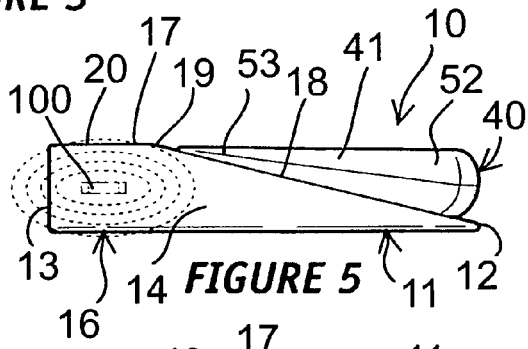
FIG. 5 is a side elevational view of the child lounge of FIG. 1, the opposing side elevational view being a substantial mirror image thereof.
Figure 6:
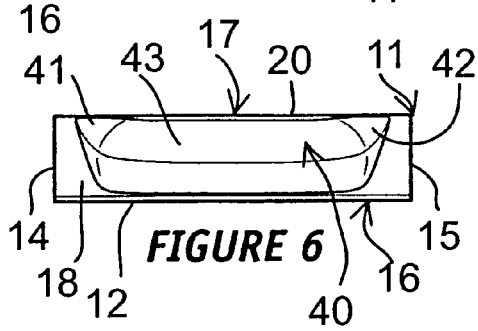
FIG. 6 is a rear end elevational view of the child lounge of FIG. 1.

As seen in FIGS. 1–3, a support 40 is attached to inclined surface 18 and projects outwardly therefrom. Support 40 is generally U-shaped and consists of three main components, namely, opposing, elongate lateral guards 41 and 42, and an elongate transverse body-supporting element 43. Referring also to FIGS. 4 and 7, element 43 is generally parallel to edge 19, is disposed adjacent proximal end 12, and has opposing ends 50 and 51, in which end 50 is directed toward side 14, and end 51 is directed toward side 15. Lateral guard 41 has a proximal end 52, which is disposed proximate proximal extremity 12 and attached to end 50 of element 43, and an opposing distal end 53. Lateral guard 41 is located adjacent side 14, and extends upwardly along inclined surface 18, and also tapers, from its proximal end 52 to its distal end 53, which is disposed proximate edge 19. Distal end 53 of lateral guard 41 does not encroach onto and obstruct generally horizontal surface 20. Lateral guard 42 is spaced apart from, and generally parallel to lateral guard 41. Lateral guard 42 has a proximal end 54, which is disposed proximate proximal extremity 12 and attached to end 51 of element 43, and an opposing distal end 55. Lateral guard 42 is located adjacent side 15, and extends upwardly along inclined surface 18, and tapers, from its proximal end 54 to its distal end 55, which is disposed proximate edge 19. Distal end 55 of lateral guard 42 does not encroach onto and obstruct generally horizontal surface 20. Lateral guards 41 and 42 taper upwardly from proximal end 12 of base 11 to edge 19 as previously intimated, and are substantially coextensive relative to one another and substantially equal in size. Support 40 can be considered part of base 11, if desired. As a matter of disclosure, FIG. 5 is a side elevational view of lounge 10 illustrating base 11 and support 40, in which the opposing side elevational is a substantial mirror image thereof, and FIG. 6 is a rear elevational view of lounge 10.

Support 40 can be integrally formed, or fashioned from a plurality of attached parts, if desired. Although lateral guards 41 and 42, and element 43, are connected to one another in the preferred embodiment herein disclosed so as to form its generally U-shaped character, they can be provided as separate parts attached to inclined surface 18, if desired. Support 40 can be integrally fashioned with inclined surface 18 of base 11, or attached to inclined surface 18 with sewing, adhesive, hook and loop fasteners, mutual attached snap fasteners, rivets, or other selected fastening structure.

Looking now to FIGS. 3 and 7, lounge 10 is furnished with a body-supporting harness assembly 70, which is disposed atop inclined surface 18 and consists of a harness 71, constructed of a cloth or cloth-like material such as canvass or the like, having a proximal end 72 (not shown in FIG. 7) secured to inclined surface 18 of base 11 at a generally central location, and that extends outwardly therefrom to a crotch portion 78, from which extends a pair of diverging distal ends 73 and 74 that are furnished with engagement elements 75 and 76, respectively. Proximal end 72 of harness 72 is secured to inclined surface 18 with sewing, adhesive, a hook and loop fastener, or other selected fastening structure. Further to the harness assembly 70 are a proximal pair of opposing complemental engagement elements 80A and 80B, and a distal pair of opposing complemental engagement elements 81A and 81B.

Complemental engagement elements 80A and 80B are attached to base 11 proximate sides 14 and 15, respectively. In the immediate embodiment, complemental engagement elements 80A and 80B are attached to lateral guards 41 and 42, respectively, project inwardly toward one another as illustrated, and are disposed at a generally intermediate location between proximal extremity 12 and edge 19. Complemental engagement elements 80A and 80B can be attached to base 11 elsewhere, if desired, such as to inclined surface 18. Complemental engagement elements 81A and 81B are attached to base 11 proximate sides 14 and 15, respectively. In the immediate embodiment, complemental engagement elements 81A and 81B are attached to lateral guards 41 and 42, respectively, project inwardly toward one another as illustrated, and are disposed at a generally intermediate location between complemental engagement elements 80A and 80B, and edge 19. Complemental engagement elements 81A and 81B can be attached to base 11 elsewhere, if desired, such as to inclined surface 18. Complemental engagement elements 80A and 80B are mounted closer to proximal extremity 12 than complemental engagement elements 81A and 81B, and complemental engagement elements 81A and 81B are mounted closer to distal extremity 13 than complemental engagement elements 80A and 80B. Accordingly, complemental engagement elements 80A and 80B are considered proximally mounted, and complemental engagement elements 81A and 81B are considered distally mounted.

Engagement elements 75 and 76 are detachably engagable to complemental engagement elements 80A and 80B, respectively, as in FIGS. 1, 3, 4, and 7, so as to define a lowered position of harness 71 and thus of harness assembly 70. Engagement elements 75 and 76 are also detachably engagable to complemental engagement elements 81A and 81B, respectively, as generally depicted in FIG. 2, so as to define a raised position of harness 71 and thus of harness assembly 70. In the lowered position of harness assembly 70, harness 71 is disposed toward proximal extremity 12 of lounge 10 and, moreover, away from distal extremity 13 and generally horizontal surface 20, so as to define a lowered body-supporting position. In the raised position of harness assembly 70, harness 71 is disposed away from proximal extremity 12 and, moreover, toward generally horizontal surface 20 and distal extremity 13, so as to defined a raised body-supporting position. When engagement elements 75 and 76 are secured, whether to complemental engagement elements 80A and 80B or to complemental engagement elements 81A and 81B, harness assembly 70 is considered closed. In each of its closed positions, harness 71 defines leg openings 85 and 86 (FIG. 3). When engagement elements 75 and 76 are detached, whether from complemental engagement elements 80A and 80B or from complemental engagement elements 81A and 81B, harness assembly 70 is considered open.

In the immediate embodiment, engagement elements 75 and 76 are well-known male clip elements, and complemental engagement elements 80A,80B,81A,81B are corresponding well-known female clip elements. Those having regard for the art will appreciate that other forms of detachably engageable engagement pairs can be used for the engagement elements and the complemental engagement elements of harness assembly 70, including hook and loop fasteners, mutual snap fasteners, mutual hook fasteners, etc.

As previously explained, lounge 10 is useful for holding and supporting child 30 in a supine position as in FIGS. 1 and 7, and a prone position as in FIG. 2. To place child 30 onto lounge 10 in the supine position as in FIGS. 1 and 7, harness assembly 70 is opened and child 30 is placed onto inclined surface 18 between lateral guards 41 and 42, with his head directed upward toward edge 19, his back directed against inclined surface 18, his bottom directed against element 43, and his legs positioned over element 43, and this the child will do naturally as element 43 functions to provide support for the legs of a child so positioned on lounge in the supine position as illustrated. Harness 71 is pulled over child and engagement elements 75 and 76 secured to complemental engagement elements 80A and 80B, respectively, securing harness assembly 70 in its lowered position, with the child's right leg disposed through leg opening 85 and his left leg disposed through leg opening 86, as shown in FIG. 7. So closed in its lowered position, harness assembly 70 functions to secure child 30 in place in a lowered position on inclined surface 18 toward proximal extremity 12, while lateral guards 41 and 42 cooperate to inhibit lateral movement of child 30 positioned therebetween on inclined surface 18. With child 30 positioned onto and held by lounge 10 in the supine position as shown, lounge 10 provides a safe place for child 30 to sleep and rest, in which sleep and rest is promoted by the inclination of the child's body as provided by inclined surface 18, and this aspect is well known in the art. To remove child 30 from lounge, the foregoing steps taken to place child 30 onto lounge in a supine position need only be reversed.

To place child 30 onto lounge 10 in the prone position as in FIG. 2, harness assembly 70 is opened and child 30 is placed onto inclined surface 18 between lateral guards 41 and 42, with his head directed upward toward generally horizontal surface 20, his front directed against inclined surface 18 and generally horizontal surface 20, his bottom and legs directed downwardly toward element 43. Harness 71 is pulled over child and engagement elements 75 and 76 secured to complemental engagement elements 81A and 81B, respectively, securing harness assembly 70 in its raised position, with the child's right leg disposed through leg opening 86 and his left leg disposed through leg opening 85. So closed, harness assembly 70 functions to secure child 30 in place in a raised position on inclined surface 18 toward horizontal surface 20 and distal extremity 13, while lateral guards 41 and 42 cooperate to inhibit lateral movement of child 30 positioned therebetween on inclined surface 18. With child 30 positioned onto and held by lounge 10 in the prone position as shown, the upper torso of the child's body is forced outwardly over generally horizontal surface 20 so as to confront generally horizontal surface. In this raised position of child as defined by the raised position of harness assembly 70, child 30 is able to place his hands onto generally horizontal surface 20 and push himself up as illustrated. Generally horizontal surface 20 promotes this activity, namely, child 30 pushing himself up therefrom as shown in FIG. 2, which functions to promote strengthening of the muscles of the child's arms, neck, and back. When child 30 becomes fatigued or tired, child 30 can, of course, rest his body and head against generally horizontal surface 20. To remove child 30 from lounge, the foregoing steps taken to place child 30 onto lounge in a prone position need only be reversed.

Figure 9:
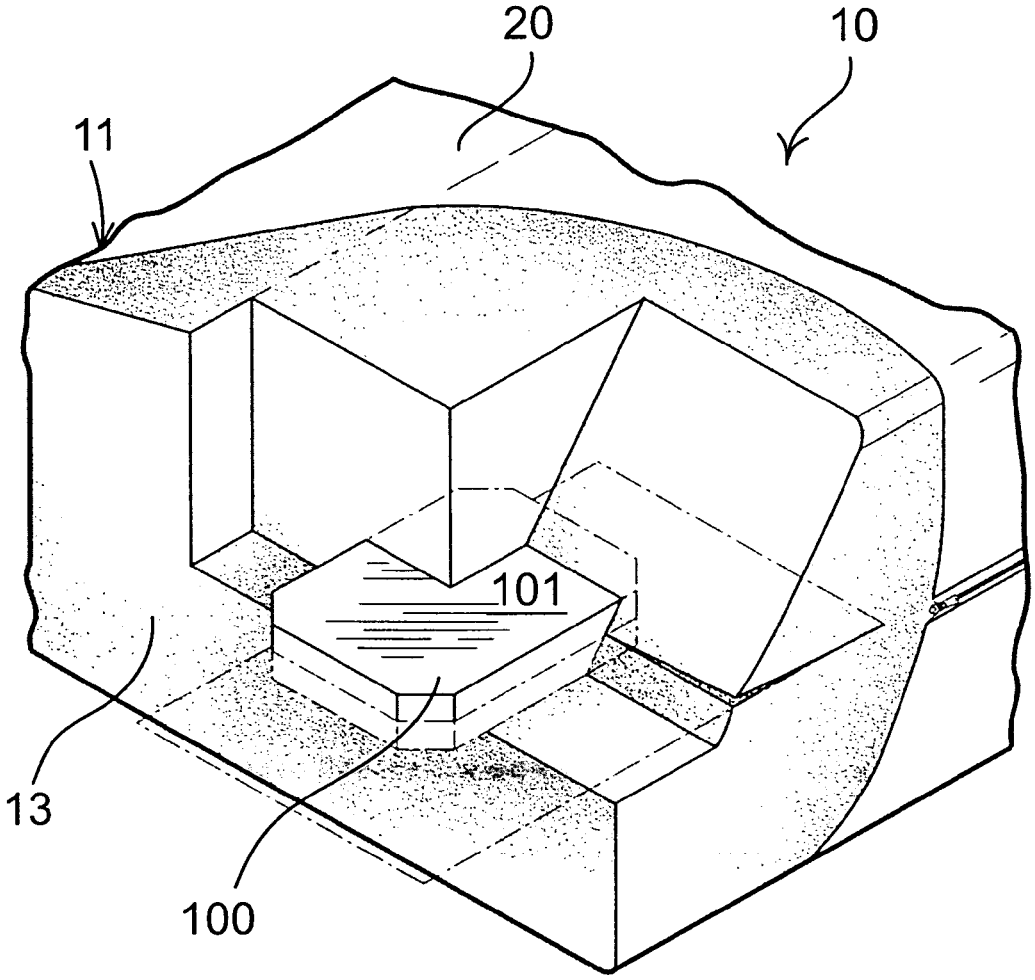
FIG. 9 is a fragmented perspective view of the child lounge of FIG. 3, with portions thereof broken away illustrating a pocket formed into the child lounge and the vibrator disposed therein.

Looking to FIG. 9, there is seen a fragmented isometric view of lounge 10 illustrating distal extremity 13 of base 11 with a pocket 101 formed therein, into which is disposed a conventional electronic vibrator 100. Vibrator 100 is conventional in nature and battery-powered, and is adapted and arranged to be turned ON and OFF with an ON/OFF switch. When turned ON, vibrator 100 vibrates. The vibrations provided by vibrator 100 are transmitted to lounge 10 and, thus, to a child positioned therein. The imparted vibrations provided by vibrator 100 promote relaxation in a child positioned on lounge 10, whether in the supine position or the prone position.

Figure 8:
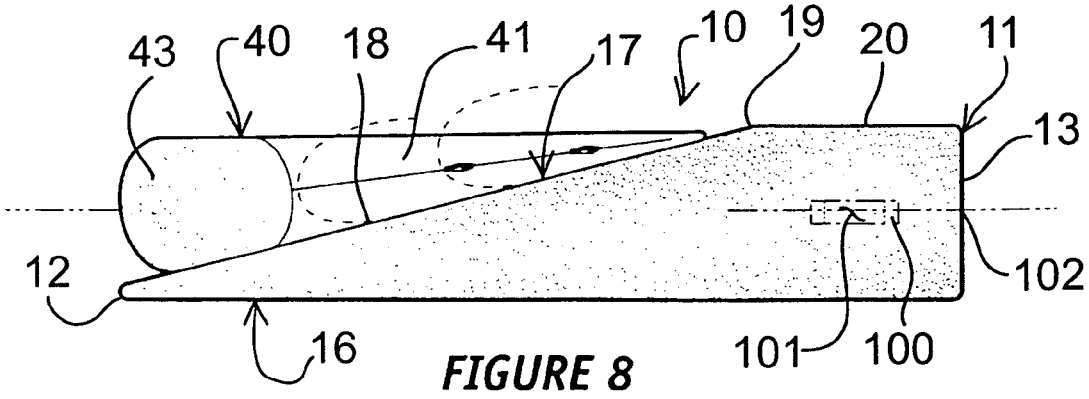
FIG. 8 is a sectional view taken along line 8—8 of FIG. 7.

Looking to FIGS. 3 and 4, vibrator 100, which is denoted schematically in phantom outline, is embedded in base 11 and is located underneath generally horizontal surface 20 at a generally intermediate location between sides 14 and 15, and this positioning of vibrator 100 is important because it focuses the generated vibrations at distal extremity 13 of lounge 10 and, moreover, to the upper torso and extremities of a child positioned on lounge 10, whether in the supine position or the prone position. Pocket 101 is preferably open from distal extremity 13 as provided by opening 102 denoted in FIGS. 2, 3, and 8, so that pocket 101 can be accessed therethrough for accessing vibrator 100 disposed therein for turning it ON and OFF, for replacement, for repair, and for replacement of batteries. Pocket 101 can be open elsewhere, if desired, such as from generally horizontal surface 20, lower face 16, etc. Also, vibrator 100 can be positioned so as to direct its ON/OFF switch toward opening 101 for easy access. The ON/OFF switch of vibrator 100 can also be disposed externally, if desired, for easy and convenient access thereto. FIG. 8 is a sectional view taken along line 8—8 of FIG. 7, and illustrates pocket 101 and vibrator 100 disposed therein, and the general positioning of vibrator 100. It will be understood that the foregoing brief description of vibrator 100 intended to be generally representative of a typical vibrator. Details not specifically illustrated and described will be readily understood and appreciated by those skilled in the art.

Although desirable as explained in this specification, support 40 can be omitted, if desired. Further to this aspect, lateral guards 41 and 42 can be omitted, if desired, and element 43 retained. Still further to this aspect, element 43 can be omitted, if desired, and lateral guards 41 and 42 retained.

The invention has been described above with reference to a preferred embodiment. However, those skilled in the art will recognize that changes and modifications may be made to the embodiment without departing from the nature and scope of the invention. For instance, lounge 10 can incorporate one or more receptacles, whether attached thereto or formed therein, for holding bottles, juice cups, and other forms of beverage containers or objects, etc. Lounge 10 can also incorporate one or more pockets, whether attached thereto or formed therein, for holding toys, combs, brushes, tissue paper, cleansing wipes, bottles of lotion or other topical preparations, etc. Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. Apparatus for holding and supporting an infant comprising:

a base including a proximal extremity, an opposing distal extremity, and an edge therebetween, an inclined surface extending from the proximal extremity to the edge, and a generally horizontal surface extending from the edge to distal extremity;

an elongate transverse body-supporting element attached to the inclined surface adjacent the proximal extremity; and a body-supporting harness assembly attached to the base and located atop the inclined surface, which is movable between a first body supporting position away from the general horizontal surface and toward the elongate transverse body-supporting element and a second body-supporting position toward the generally horizontal surface and away from the elongate transverse body-supporting element.

2. Apparatus of claim 1, further comprising:

the base having opposing sides;

an elongate first lateral guard attached to the inclined surface adjacent one of opposing sides of the base, and extending from proximate the proximal extremity to proximate the edge; and an opposing elongate second lateral guard attached to the inclined surface adjacent the other of the opposing sides of the base, and extending from proximate the proximal extremity to proximate the edge;

wherein the first and second lateral guards cooperate to inhibit lateral movement of an infant positioned therebetween on the inclined surface.

3. Apparatus of claim 2, wherein the first lateral guard tapers upwardly from the proximal extremity of the base to the edge.

4. Apparatus of claim 2, wherein the second lateral guard tapers upward from the proximal extremity of the base to the edge.

5. Apparatus of claim 1, further comprising a vibrator attached to the base for vibrating the base.

6. Apparatus of claim 5, further comprising:

a pocket extending into the base underneath the generally horizontal surface; and the vibrator disposed in the pocket.

7. Apparatus for holding and supporting an infant comprising:

a base including a proximal extremity, an opposing distal extremity, and an edge therebetween, an inclined surface extending from the proximal extremity to the edge, a generally horizontal surface extending from the edge to distal extremity, and a pocket extending into the base underneath the generally horizontal surface, which is adapted to receive therein a vibrator operable for vibrating the base; and a body-supporting harness assembly attached to the base and located atop the inclined surface, which is movable between a first body supporting position away from the general horizontal surface and a second body-supporting position toward the generally horizontal surface.

8. Apparatus of claim 7, further comprising a vibrator disposed in the pocket.

9. Apparatus of claim 7, further comprising:

the base having opposing sides;

an elongate first lateral guard attached to the inclined surface adjacent one of opposing sides of the base, and extending from proximate the proximal extremity to proximate the edge; and an opposing elongate second lateral guard attached to the inclined surface adjacent the other of the opposing sides of the base, and extending from proximate the proximal extremity to proximate the edge;

wherein the first and second lateral guards cooperate to inhibit lateral movement of an infant positioned therebetween on the inclined surface.

10. Apparatus of claim 9, wherein the first lateral guard tapers upwardly from the proximal extremity of the base to the edge.

11. Apparatus of claim 9, wherein the second lateral guard tapers upward from the proximal extremity of the base to the edge.

12. Apparatus of claim 7, further comprising an elongate transverse body-supporting element attached to the inclined surface adjacent the proximal extremity.

13. Apparatus for holding and supporting an infant comprising:

a base including opposing sides, opposing proximal and distal extremities, and a transverse edge between the proximal extremity and the distal extremity, an inclined surface extending from the proximal extremity to the edge, and a generally horizontal surface extending from the edge to distal extremity;

a body-supporting harness assembly attached to the base and located atop the inclined surface, which is movable between a first body supporting position away from the general horizontal surface and a second body-supporting position toward the generally horizontal surface;

an elongate first lateral guard attached to the inclined surface adjacent one of opposing sides of the base, and extending from proximate the proximal extremity to proximate the edge; and an opposing elongate second lateral guard attached to the inclined surface adjacent the other of the opposing sides of the base, and extending from proximate the proximal extremity to proximate the edge;

wherein the first and second lateral guards cooperate to inhibit lateral movement of an infant positioned therebetween on the inclined surface.

14. Apparatus of claim 13, wherein the first lateral guard tapers upwardly from the proximal extremity of the base to the edge.

15. Apparatus of claim 13, wherein the second lateral guard tapers upward from the proximal extremity of the base to the edge.

16. Apparatus of claim 13, further comprising an elongate transverse body-supporting element attached to the inclined surface adjacent the proximal extremity and to the first and second lateral supports.

17. Apparatus of claim 13, further comprising a vibrator attached to the base for vibrating the base.

18. Apparatus of claim 17, further comprising:

a pocket extending into the base underneath the generally horizontal surface; and the vibrator disposed in the pocket.

* * * * *